US007533437B1

(12) United States Patent
Gartner

(10) Patent No.: US 7,533,437 B1
(45) Date of Patent: May 19, 2009

(54) SWIVEL PAINTING TOOL

(75) Inventor: Perry Gartner, Englewood, NJ (US)

(73) Assignee: Brenner International Corp

( * ) Notice: Subject to any disclaimer, the term of this patent is extended or adjusted under 35 U.S.C. 154(b) by 399 days.

(21) Appl. No.: 11/164,350

(22) Filed: Nov. 18, 2005

Related U.S. Application Data

(63) Continuation-in-part of application No. 10/605,619, filed on Oct. 14, 2003, now Pat. No. 7,028,363.

(51) Int. Cl.
*B05C 17/00* (2006.01)
*B05C 17/02* (2006.01)

(52) U.S. Cl. ..... 15/210.1; 15/144.2; 15/145

(58) Field of Classification Search ..... 15/143.1, 15/144.1, 144.2, 145, 209.1, 210.1
See application file for complete search history.

(56) References Cited

U.S. PATENT DOCUMENTS

| | | | | |
|---|---|---|---|---|
| 4,219,899 | A * | 9/1980 | Zurawin et al. | 15/144.2 |
| 6,073,298 | A * | 6/2000 | O'Brien | 15/160 |
| 6,305,043 | B1 * | 10/2001 | Rosnak | 15/144.2 |
| 2002/0148057 | A1 * | 10/2002 | Hobden | 15/144.1 |

* cited by examiner

*Primary Examiner*—Randall Chin
(74) *Attorney, Agent, or Firm*—Richard A Joel

(57) ABSTRACT

This painting tool comprises a unique swiveling pad painter with a positive locking spring to lock the pad painter in a fixed position when desired. The spring projects through a threaded portion of the handle coupling to lock the pad in a fixed position. The spring may be overridden when moving to another fixed position. A unique contoured handle configuration is included to assist painting.

9 Claims, 3 Drawing Sheets

SWIVEL PAINTING TOOL

This application relates to swivel pad painters and particularly to pad painters which can also be locked in a fixed position with a novel locking arrangement. This continuation in part application is an improvement on applicant's pending application Ser. No. 10/605,619 filed on Oct. 14, 2003 now U.S. Pat. No. 7,028,363.

The painting tool of this invention is capable of operating a pad painter in a swivel mode through 360° as well as being locked in different fixed positions. This patent includes a spring member, which locks the painting tool in a fixed position determined by the painter. The swivel mode permits an increase in speed of painting and is particularly effective when an extension pole is attached to the handle. The painting tool involves but is not restricted to a pad painter. Another embodiment, for example, involves spatter guard rollers.

The prior art includes paint applicators which have a mechanism to move the applicator to various fixed positions with regard to the handle and a locking means wherein the applicator can be moved and locked in a number of fixed positions but all in the same vertical plane.

The prior art includes patent publication 2002/01408057 to Hobden which discloses an adjustable handle for a paint pad. The handle can be pivoted a selected number of degrees relative to the pad holder plate and includes a lock sleeve that can be used for locking the handle in selected angular positions relative to the plate.

U.S. Pat. No. 4,219,899 to Zurawin discloses a paint support and handle assembly wherein the handle is mounted for swinging movement of about 90°. A spring clip is used for biasing the handle in a given direction.

Also of interest are U.S. Pat. Nos. 6,305,043 and 6,073,298. No patents disclose applicant's unique roller design or pad design, which swivels through 360° and improves the speed and efficiency of painting. Nor does the prior art disclose applicant's painting tool which may be positively locked in a number of fixed positions.

This invention relates to painting tools such as a pad painter, which may be operated in a unique swivel mode. The pad painter range of motion for painting is extended to 360° with this invention. The pad painter comprises a pad rotatably affixed to an elongated plastic holder having an externally threaded portion on the upper surface thereof extending upwardly to receive the handle coupling member. A spring projects outwardly from the threads to engage the coupling member and provide locking means. The threaded portion of the holder includes a recessed socket joint of a hemispherical configuration within the projecting portion, which is located on the plastic holder for the pad.

The handle includes a unique elongated configured gripping portion at one end and a curved portion at the other end terminating in a slotted ball or sphere. A substantially v-shaped spring is mounted internally within the raised threaded portion of the holder with one end molded into the plastic threaded portion and the other locking end located 180° opposite thereto and projecting through the thread. An internally threaded cap having a central aperture is slidably mounted over the curved end portion. The cap is screwed onto the externally threaded upper coupling member locking the ball within the socket engaging the spring and permitting the ball with the handle to swivel about the socket. The roller painter may swivel at any angle. This swivel mode permits an increase in the speed of painting. Alternatively, the roller may be locked in a fixed position by tightening the cap against a washer located on the upper surface of the externally threaded portion. The spring projecting through the threads and engaging the cap provides a positive locking means but one which can be manually overridden to set the particular pad angle.

Another embodiment of this invention involves a swiveling paint roller, which also includes a mechanism for locking the roller in a plurality of fixed positions. The handle and socket joint design are similar to the previously described pad assembly Accordingly, an object of this invention is to provide a new and improved swiveling pad painter.

Another object of this invention is to provide a swiveling pad painter wherein the handle may operate in a swivel mode with respect to the handle extending the range of painting motion.

A further object of this invention is to provide a new and improved pad painter or other painting tool wherein the handle may be positively locked in a fixed position or swivel to any other position within 360° to facilitate painting.

A further object of this invention is to provide a new and improved painting tool having a unique coupling to a handle to permit swiveling or operating in a fixed mode with positive locking means.

A still further object of this invention is to provide a new and improved pad painter, which may swivel or be locked in a fixed position with spring locking means.

A more specific object of this invention is to provide a new and improved painting tool having a uniquely configured handle with a ball at one end, which engages a recessed socket joint on a coupling member positioned on the pad holder to permit operating the pad either in a 360° swivel mode or in a fixed position with spring locking means engaging the coupling member.

The above and other objects and advantages of the invention may be more clearly seen when viewed in conjunction with the accompanying drawings wherein.

Figure 1:
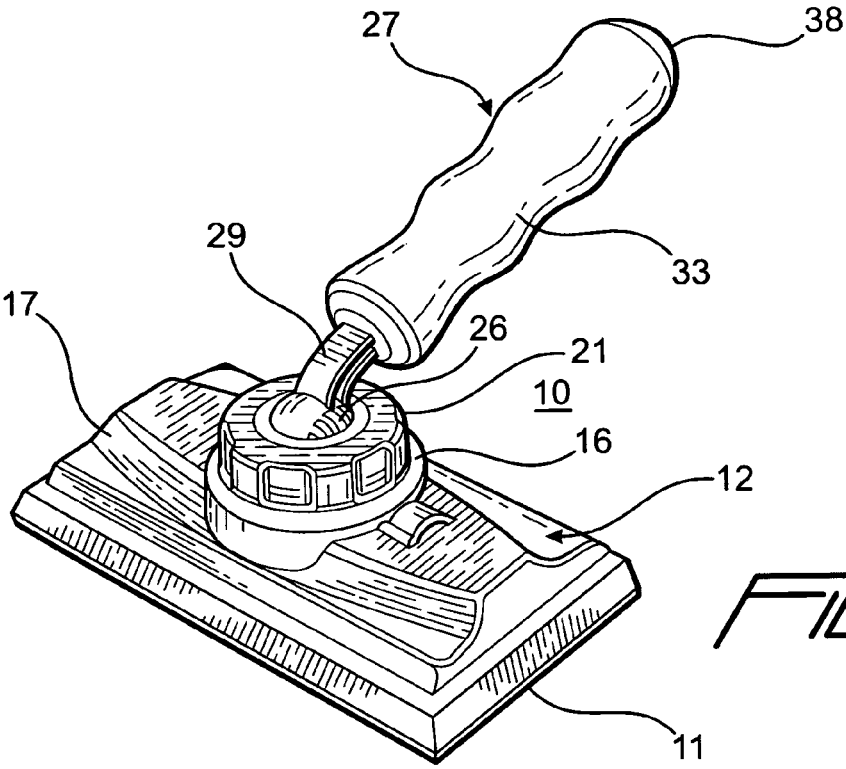
FIG. 1 is a perspective view of the pad painter comprising the invention.
Figure 2:
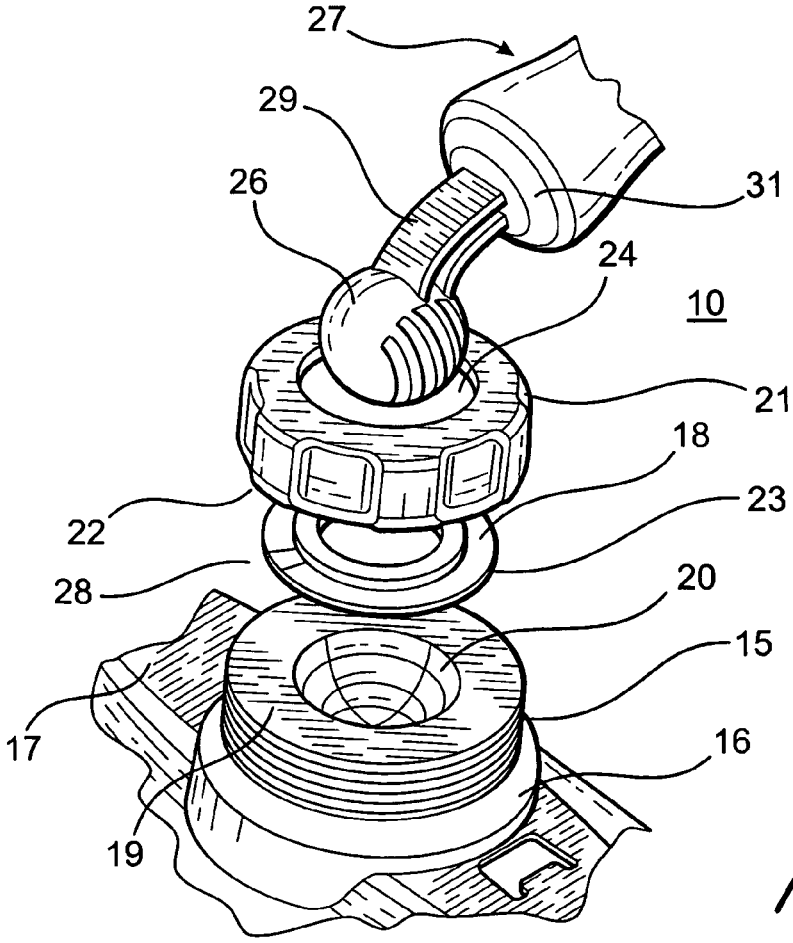
FIG. 2 is an exploded view of the swiveling pad painter comprising the invention.

As shown in FIGS. 1 and 2, a swivel pad painter 10 comprises a pad 11 mounted to the holder 12. A threaded member 15 extends upwardly from the mounting surface 16 on the upper portion 17 of the holder 12 forming a hemispherical socket 20. An important improvement is raising the threaded member 15 so that more of the global head or ball 26 engages the socket 20. A ring washer 18 is mounted on the upper surface 19 of the threaded member 15 and may include serrations 23 for gripping. A nut 21 with downwardly extending internally threaded sides 22 engages the threaded member 15. The nut 21 also includes an aperture 24 on its upper surface 25 through which a ball 26 on the end of the handle 27 extends. The ball 26 rotates in the socket 20 and is held therein by the washer 18 and nut 21. The raised portion 15 holds the handle 27 much tighter in the fixed position than conventional designs. The washer 18 also includes a slit 28, which permits expansion of the washer 18 so that it can be located on the interior handle side of the ball 26.

Figure 3:
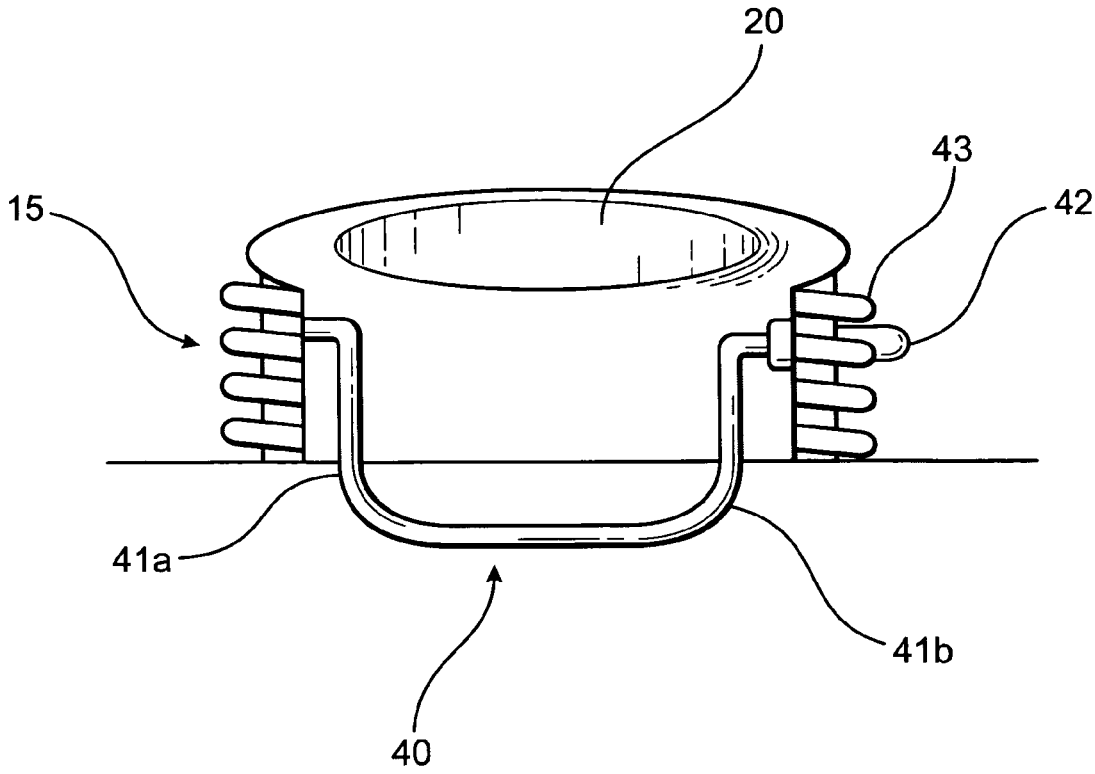
FIG. 3 is a partial cross sectional view of the pad holder showing the spring mounted to the internal portion of the raised threaded portion.
Figure 4:
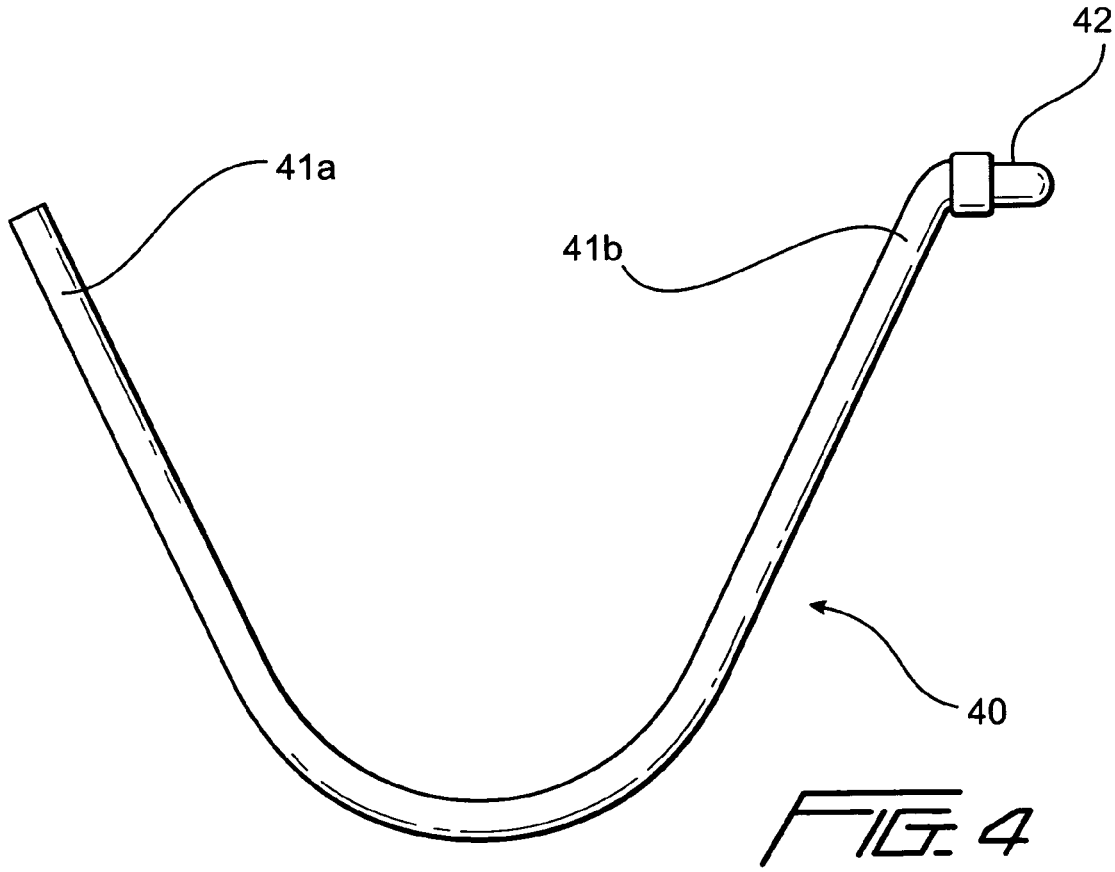
FIG. 4 is an enlarged view of the locking spring.

A spring 40 as shown in FIG. 3 projects through the threads 43. The spring 40 is substantially U-shaped with legs 41*a* and 41*b*. A shaped plastic end member 42 mounted on the spring 40 protrudes through the threads 43 on member 15. The other end on leg 41*a* is anchored internally in the threads 43 and terminates at the base of the threads 43. The spring 40 stops the nut 21 from unscrewing from the threaded portion 43. The spring 40 thus provides a unique and inexpensive means to maintain the nut 21 in position.

Figure 5:
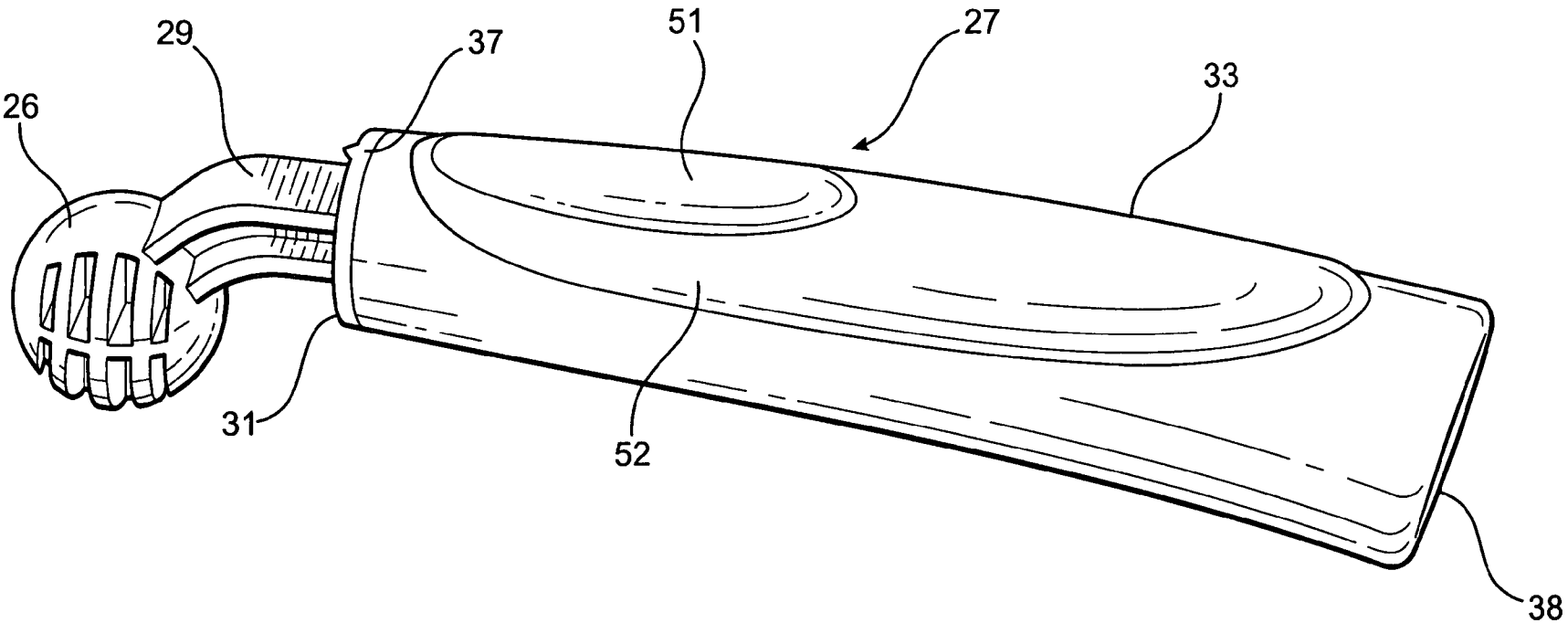
FIG. 5 depicts the unique handle utilized with this invention.

The ball or globe head 26 is integrally mounted on the curved end 29 of the handle 27. The curved end 29 terminates in a flange 31, which forms one end of an elongated portion, not shown, which is inserted in the aperture 37 of an elongated shaped outer rubber-like cover 33 and which includes an internal thread (not shown) at its end. An elongated pole having a threaded end may be connected thereto within aperture 37 of cover 33. The cover 33 is shaped in a tapered elongated configuration with soft spots 51 and 52 on each side thereof to facilitate gripping as shown in FIG. 5 or may be contoured as shown if FIG. 1.

In use, the nut 21 may be loosened to permit the roller 11 to swivel within a total range of 360°. The swivel mode permits an increase in the speed of painting and is particularly effective with an extension pole attached to the threaded handle portion 38. As mentioned above, the nut 21 may be tightened and the spring 40 locks the pad 11 in a fixed position.

A fixed mode is used when a precise stroke is required. In that case, the nut 21 is tightened locking the ball 26 and hence the roller 11 in a fixed position relative to the handle and extension pole.

With the foregoing embodiment, the painting action is facilitated and speeded up by the swivel mode. As an option, the pad painter 40 may be locked in any number of fixed positions by tightening the nut 21 against spring 40. This design provides a positive locking arrangement or bumper, which may be used repeatedly over long periods of time without slipping problems. The invention can also be used with other tools such as sanders, etc., which can be locked in a fixed position with the spring locking means.

While the invention has been explained by a detailed description of certain specific embodiments, it is understood that various modifications and substitutions can be made in any of them within the scope of the appended claims that are intended also to include equivalents of such embodiments.

What is claimed is:

1. A painting tool comprising:

a pad having a paint-absorbing portion comprising a first side and a second side having an elongated coupling surface;

means mounted to the coupling surface having an upwardly projecting externally threaded portion including a recessed socket therein, said portion being raised to provide a secure socket;

a handle portion having a ball at a first end to engage the socket, an elongated intermediate portion connected thereto, an internally threaded portion at the other end; and, mounting means securing the ball within the socket to permit rotation of the pad through 360° and spring means projecting through the externally threaded portion to engage the mounting means permitting the pad to be positively locked in position.

2. A painting tool in accordance with claim 1 wherein:

the pad comprises an integral elongated body and wherein the coupling surface comprises a rigid substantially rectangular main body having parallel side portions, said side portions each having inwardly and upwardly extending portions forming a channel and one of said side portions having a cutaway section.

3. A painting tool in accordance with claim 1 wherein:

the externally threaded portion includes an aperture extending therethrough; and the spring means comprises a substantially U-shaped wire having one end mounted internally within the threaded portion and the other end projecting through the aperture in the threaded portion to stop the mounting means from unscrewing from the threaded portion in a swivel mode, said projecting end having a shaped plastic cap mounted over the spring means.

4. A painting tool in accordance with claim 3 wherein:

the intermediate handle portion includes one end having a portion integrally molded to the ball, a curved handle portion attached thereto and an outer elongated gripping portion extending to the other end.

5. A painting tool in accordance with claim 4 wherein:

the mounting means comprises an internally threaded nut positioned about the curved handle portion and engaging the threaded portion extending upwardly with the recessed socket and a washer mounted between the nut and the externally threaded portion, said spring means engaging the nut to prevent the nut from unscrewing from the threaded portion and wherein said spring means is slidable within the aperture in the threaded portion to be overridden when setting the position of the pad and inoperable when the nut is loosened to provide a swivel mode.

6. A painting tool in accordance with claim 4 wherein:

the outer elongated gripping portion includes a contoured rubber-gripping member mounted over the handle portion.

7. A painting tool in accordance with claim 3 wherein:

the ball is substantially spherical in configuration and includes a plurality of spaced parallel slots.

8. A painting tool in accordance with claim 1 wherein:

the mounting means securing the ball within the socket includes internal threads meshing with the upwardly extending threaded portion.

9. A painting tool comprising:

a roller and a frame having said roller mounted therein for rotation and further including an upwardly projecting externally threaded portion including a recessed socket therein, said threaded portion being raised to provide a secure socket;

a handle portion having a ball at a first end to engage the socket, an elongated intermediate portion connected thereto and, an internally threaded portion at the other end; and, mounting means securing the ball within the socket to permit rotation of the roller through 360° and spring means projecting through the projecting threaded portion to engage the mounting means permitting the roller to be positively locked in position.

* * * * *